US011499338B2

(12) United States Patent
Amaral

(10) Patent No.: US 11,499,338 B2
(45) Date of Patent: Nov. 15, 2022

(54) FENCE STRUCTURE COVER ASSEMBLY

(71) Applicant: Gabriel Amaral, Fall River, MA (US)

(72) Inventor: Gabriel Amaral, Fall River, MA (US)

( * ) Notice: Subject to any disclaimer, the term of this patent is extended or adjusted under 35 U.S.C. 154(b) by 192 days.

(21) Appl. No.: 17/098,400

(22) Filed: Nov. 15, 2020

(65) Prior Publication Data

US 2022/0154488 A1 May 19, 2022

(51) Int. Cl.
*E04H 17/16* (2006.01)
*E04H 17/00* (2006.01)

(52) U.S. Cl.
CPC ..... *E04H 17/168* (2013.01); *E04H 17/006* (2021.01)

(58) Field of Classification Search
CPC ..... E04H 17/00; E04H 17/006; E04H 17/02; E04H 17/04; E04H 17/05; E04H 17/06; E04H 17/16; E04H 17/1602; E04H 17/161; E04H 17/163; E04H 17/164; E04H 17/168
See application file for complete search history.

(56) References Cited

U.S. PATENT DOCUMENTS 3,806,095 A * 4/1974 Ford ..... E04H 17/00 256/34
3,940,114 A * 2/1976 Rivelli ..... E04H 17/02 256/25
4,773,175 A * 9/1988 Larsen ..... G09F 23/06 40/308
4,907,783 A * 3/1990 Fisk ..... E04H 17/06 47/33
5,197,248 A * 3/1993 Kruse ..... E04H 17/1417 52/309.7
5,218,797 A * 6/1993 Kruse ..... E04B 1/86 52/468
5,421,557 A * 6/1995 Vise ..... E04H 17/003 256/22
5,702,090 A * 12/1997 Edgman ..... E04H 17/1447 256/65.02
5,901,482 A * 5/1999 Sawyer ..... B62B 3/1408 40/611.05
6,712,340 B1 * 3/2004 Clarmont ..... E04H 17/16 256/19
6,719,276 B1 * 4/2004 Bush ..... G09F 15/0006 40/606.03
7,086,641 B2 * 8/2006 Petrozziello ..... E04H 17/066 256/32
7,478,797 B2 * 1/2009 Laws ..... E04H 17/168 52/316
7,997,560 B2 * 8/2011 Bergdoll ..... E04H 17/066 256/67

(Continued)

*Primary Examiner* — Jonathan P Masinick

(57) ABSTRACT

A fence structure cover assembly is described herein and improves the appearance and function of preexisting fencing. The cover assembly is an interlocking system of fence panels and posts that fits and interlocks over and around preexisting fences and is formed of multiple panels that are provided with aesthetically pleasing indicia and/or textures. The upper and lower protruding panels contain at their ends tongue and groove type locking mechanism to secure the panels at their ends while the first and second panels are further securable via predrilled thru holes to secure the panels together. The first and second panels are mateable and can come in different sizes where a short width may be required.

9 Claims, 15 Drawing Sheets

(56) References Cited

U.S. PATENT DOCUMENTS

| | | | | |
|---|---|---|---|---|
| 10,087,651 | B2 * | 10/2018 | Cavanagh | E04H 17/22 |
| 10,161,161 | B2 * | 12/2018 | Yin | E06B 9/24 |
| 10,482,864 | B1 * | 11/2019 | Johnson | E04H 17/16 |
| 10,718,133 | B1 * | 7/2020 | Maher | E04H 17/165 |
| 2005/0087733 | A1 * | 4/2005 | Weitzel | E04H 17/161 256/59 |
| 2006/0273295 | A1 * | 12/2006 | Maly | E04H 12/2261 256/45 |

* cited by examiner

FENCE STRUCTURE COVER ASSEMBLY

BACKGROUND

Fencing is used by businesses and homeowners to create boundaries, protect property, keep children and pets within a safe enclosure, and add ornamentation to existing landscape features. Fencing is manufactured in a great variety of styles and types using a wide selection of materials. Two of the most common types are chain link fence, that consists of a galvanized steel mesh supported by steel pipes, and wood stockade fencing, that consists of wood planks supported by wood posts and framing.

Although these types of fencing are extremely functional and durable, they can also be unattractive. To replace these existing fences, with an alternative fence style that is more attractive and perhaps less functional is labor intensive and usually cost prohibitive. Therefore, a need exists for a means to improve the appearance and function of preexisting fencing.

SUMMARY OF THE INVENTION

A fence structure cover assembly is described herein and improves the appearance and function of preexisting fencing. The cover assembly is an interlocking system of fence panels and posts that fits and interlocks over and around preexisting fences and is formed of multiple panels that are provided with aesthetically pleasing indicia and/or textures. These panels improve the appearance of existing fencing, provide a wind break, and insure privacy.

The panels can be formed in differing widths, heights, and include corner sections to fully cover a preexisting fence, regardless of its size.

The fence structure cover assembly comprises first, and second panels and posts that are adaptable to fit and secure over an existing fence. The first panel includes a front portion containing the aesthetic fence design and a back portion having upper and lower protruding panels. The second panel is flat and the first and second panel combination encapsulates the existing fence structure. The upper and lower protruding panels are variable in width to accommodate different fence designs, while various post structures are designed to encapsulate existing fence posts. The upper and lower protruding panels contain at their ends tongue and groove type locking mechanism to secure the panels at their ends while the first and second, panels are further securable via predrilled thru holes to secure the panels together. The first and second panels are mateable and can come in different sizes where a short width may be required.

BRIEF DESCRIPTION OF THE DRAWINGS

The foregoing and other objects, features, and advantages of the invention are apparent from the following detailed description taken in conjunction with the accompanying drawings in which.

DETAILED DESCRIPTION

In the following description, the same numerical references refer to similar elements. The embodiments, geometrical configurations, materials mentioned and/or dimensions shown in the figures or described in the present description are preferred embodiments only, given for exemplification purposes only.

Figure 1:
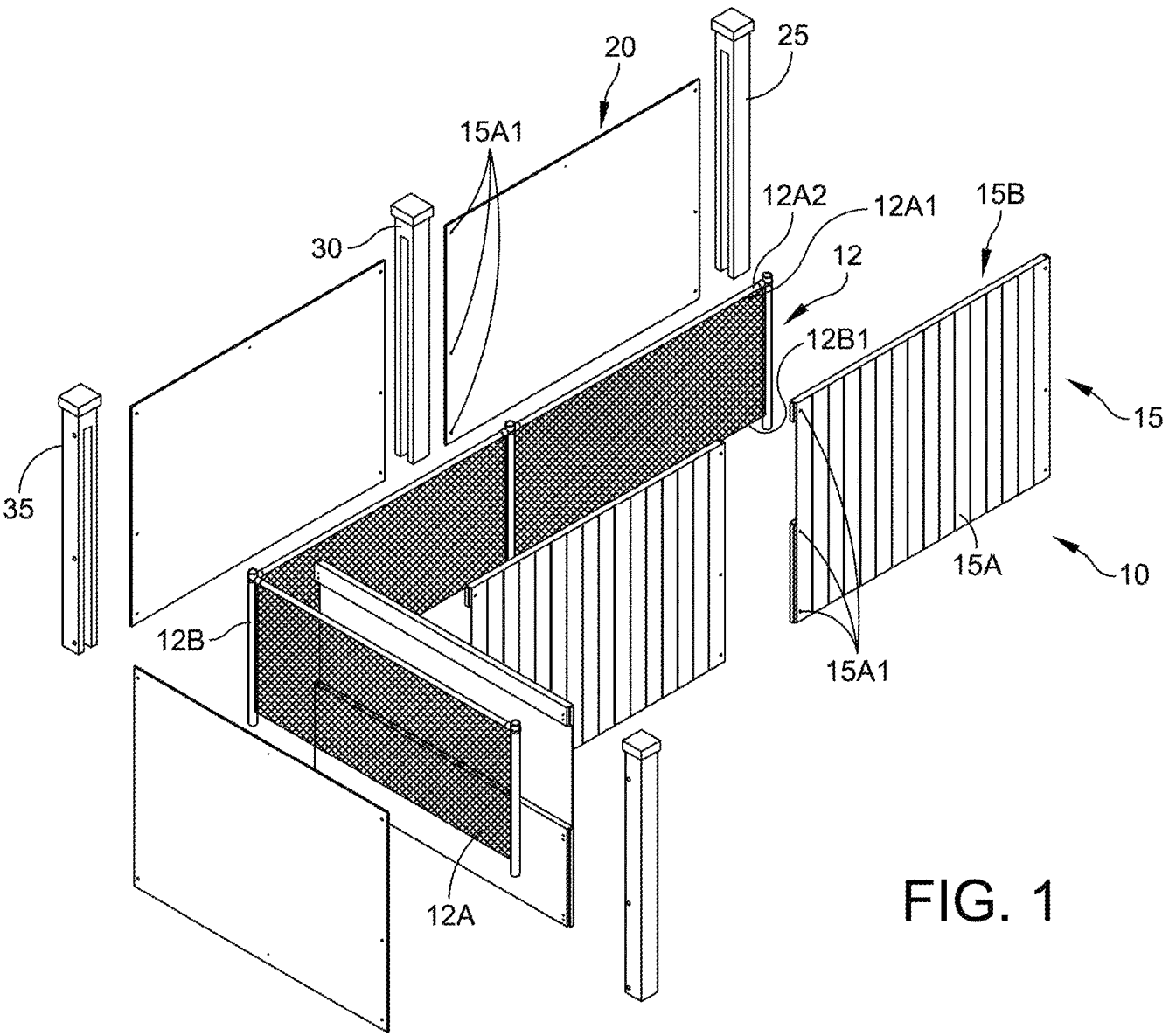
FIG. 1 is an exploded view of a fence structure surrounded by the cover assembly employing the principles of the present invention.
Figure 2:
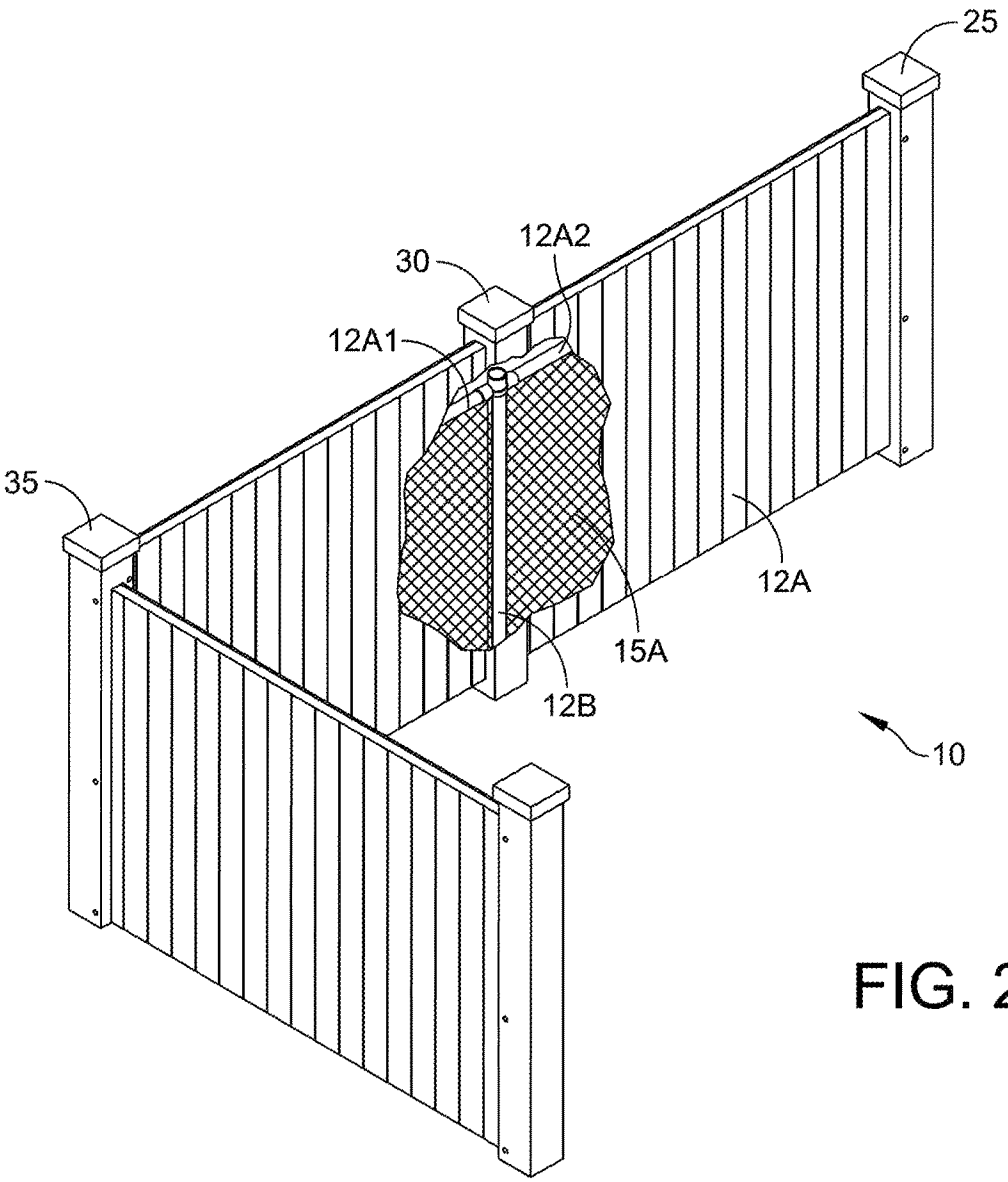
FIG. 2 is a view of an assembled FIG. 1 showing a cutout of the fence interior for illustration.
Figure 3:
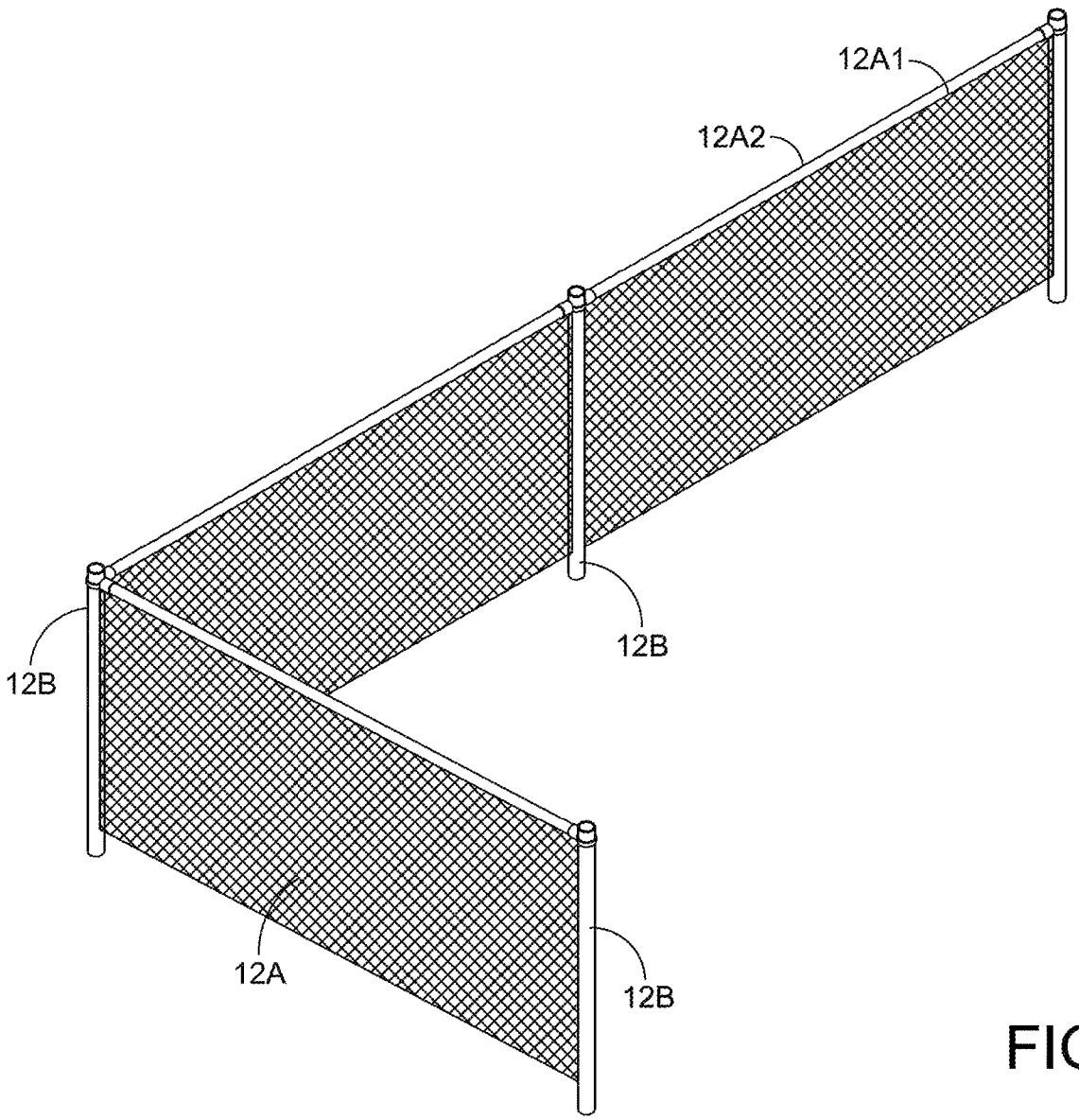
FIG. 3 is a typical existing fence structure before encapsulation pursuant to the principles of the present invention.
Figure 7A:
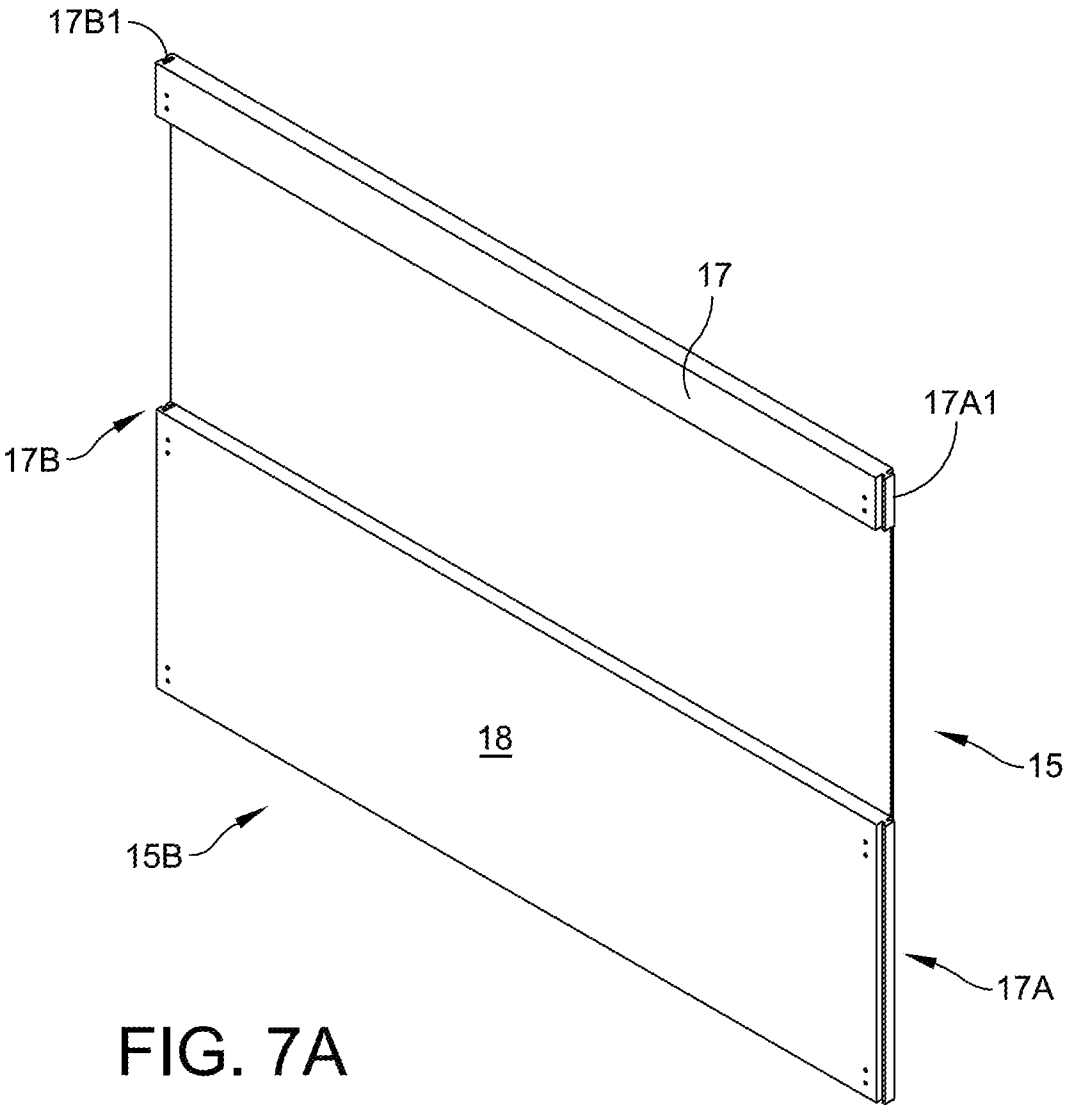
FIG. 7A is a rear perspective view of a first panel assembly of the present invention.
Figure 7D:
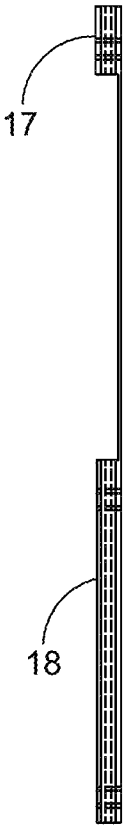
FIG. 7D is an end view of FIG. 7A.
Figure 7B:
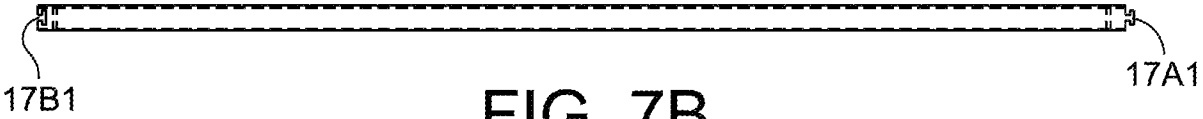
FIG. 7B is a top view of FIG. 7A.
Figure 7C:
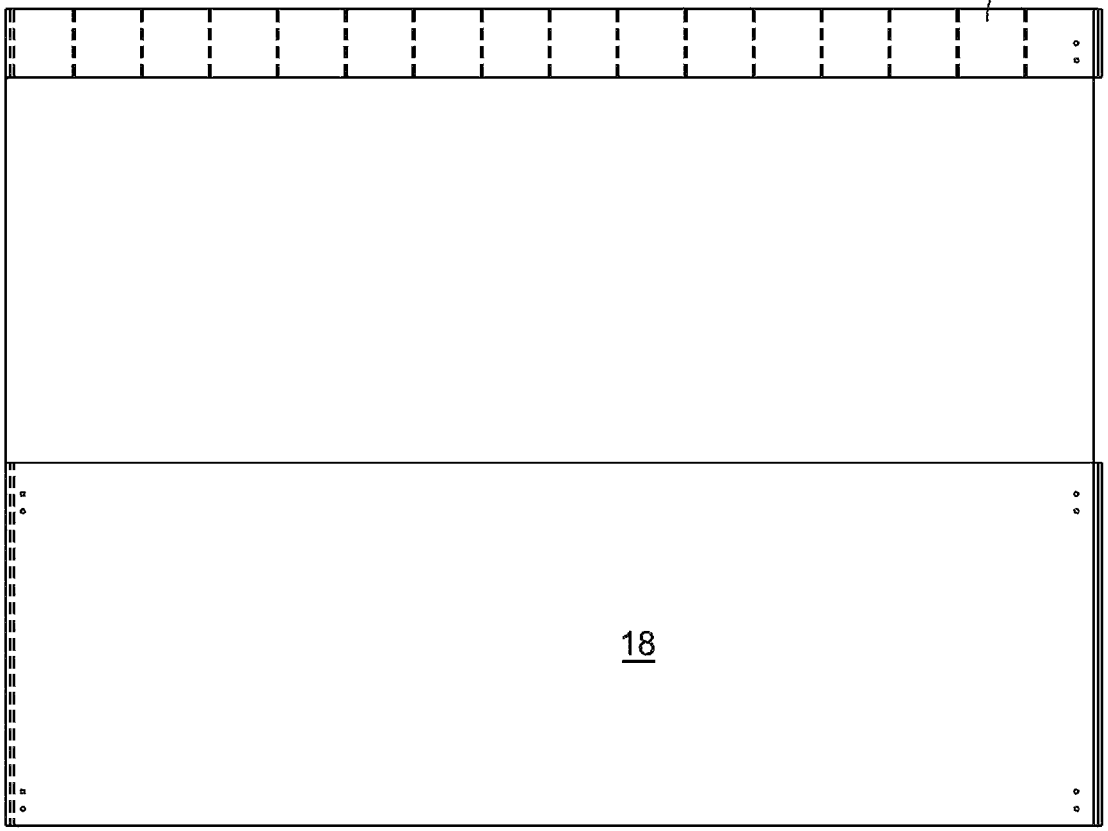
FIG. 7C is a front view of FIG. 7A.
Figure 8A:
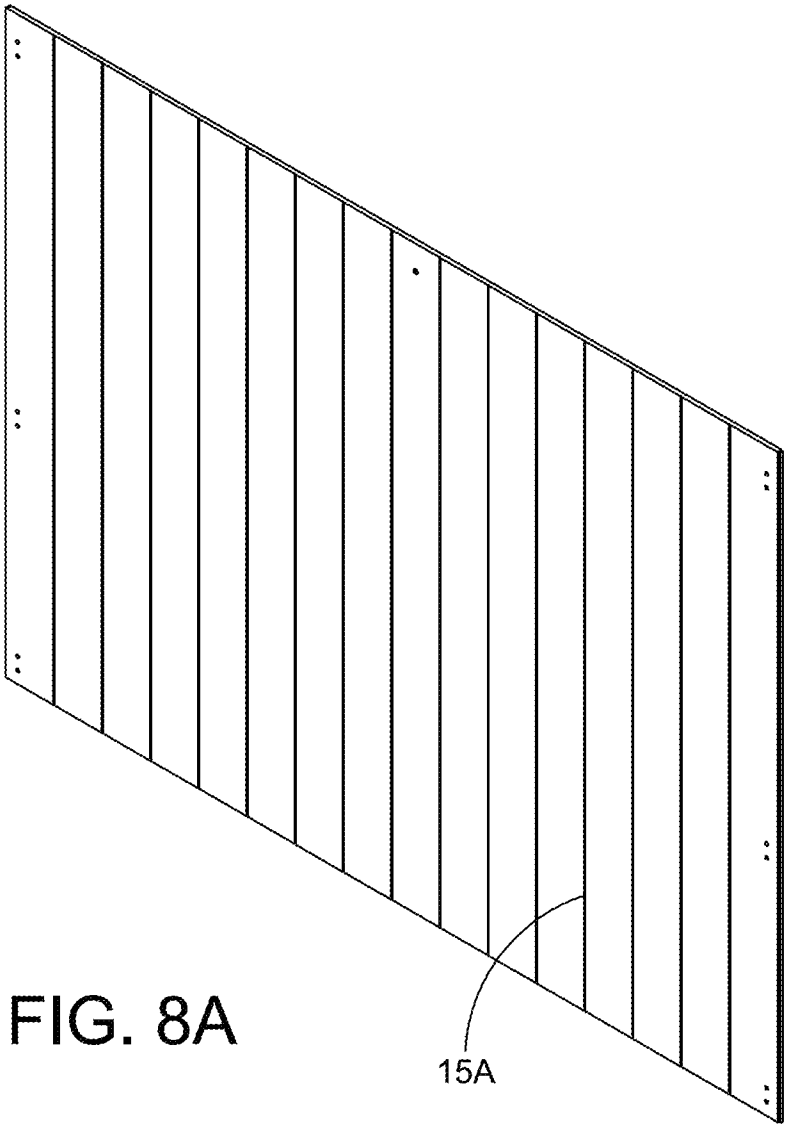
FIG. 8A is a perspective view of an embodiment of the second panel of the present invention, illustrating the front surface.
Figure 8B:
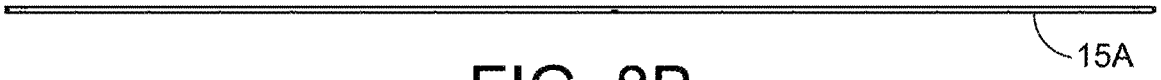
FIG. 8B is a top view of FIG. 8A.
Figure 8C:
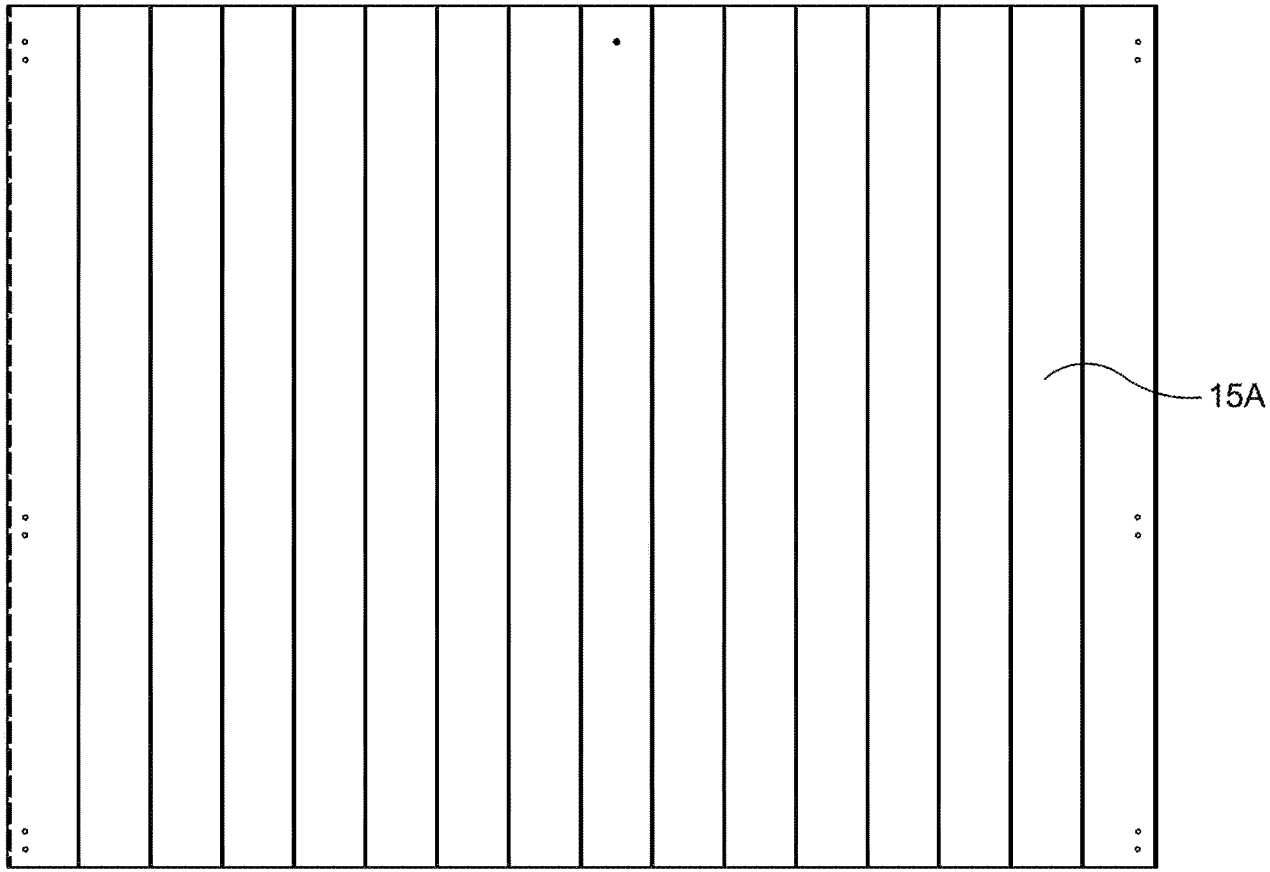
FIG. 8C is a front view of FIG. 8A.
Figure 8D:
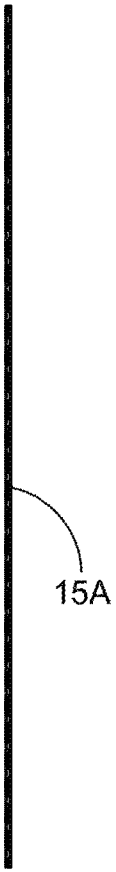
FIG. 8D is an end view of FIG. 8A.

In Referring to FIGS. 1 and 2 there is shown a preferred embodiment of the present invention, a Fence Structure Cover Assembly 10 for covering an existing fence 12 (FIG. 3), the existing fence 12 including a linked mesh 12A extending between a plurality of existing fence posts 12B, the linked mesh having an upper edge 12A1 and a lower edge 12B1. A horizontal fence post 12A2 may extend between vertical posts 12B and be positioned above link mesh upper edge 12A1. It is contemplated that a fence may or may not include a horizontal fence post and be limited, to only a linked mesh 12A extending between a plurality of existing fence posts 12B The cover assembly 10 includes a plurality of first 15 and second 20 panels that encapsulate an existing fence 12. The first, panels 15 have a front surface 15A and a back surface 15B. The front surface 15A of the first panels 15 is intended to be the visible portion of the fence and can include any design elements or surface ornamentation desired. Referring to FIG. 7A, the back surface 15B includes an upper raised thickness portion 17 and a lower raised thickness portion 18. In the preferred embodiment these raised thickness portions both extend the width of the first panel 15.

Figure 5:
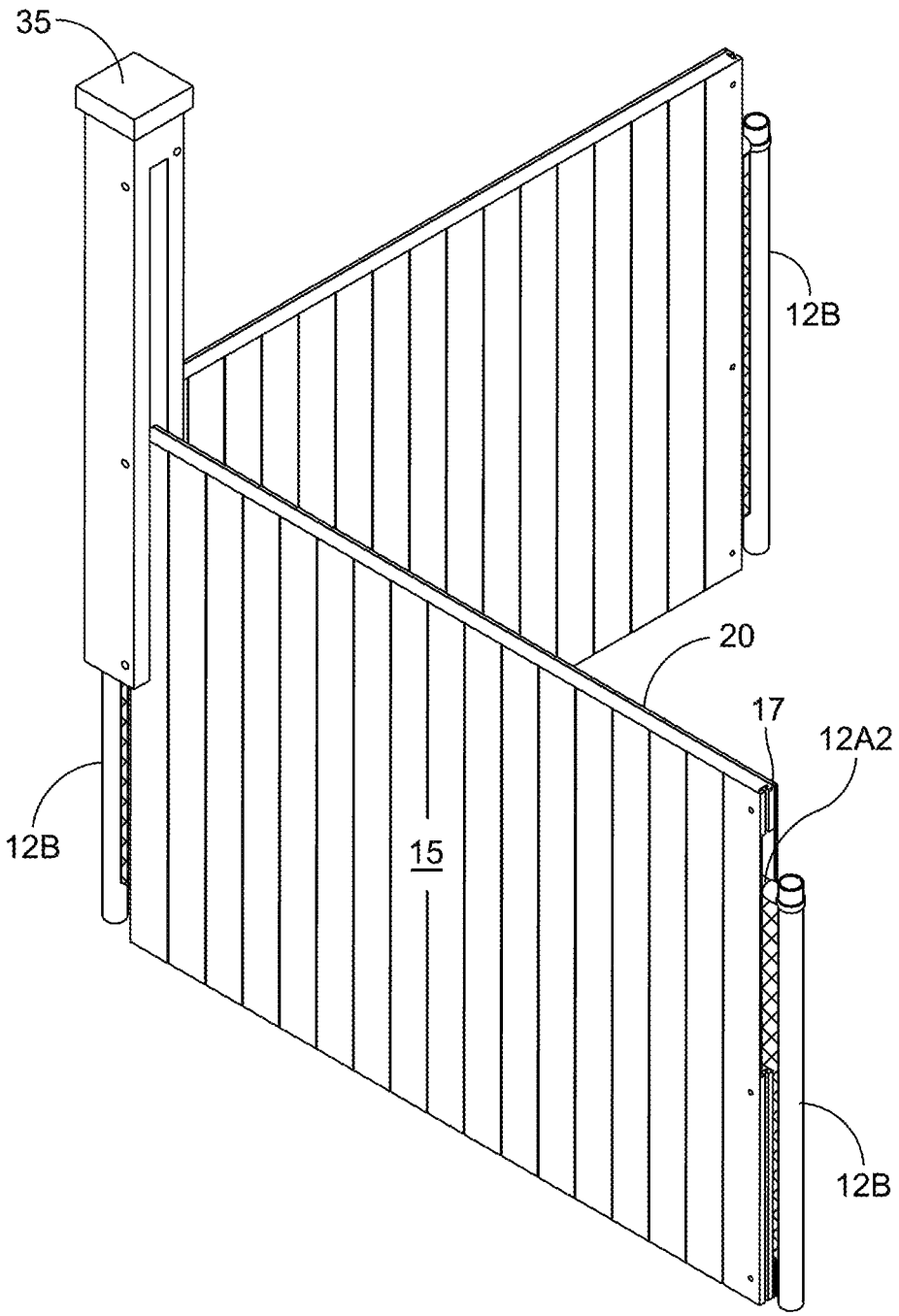
FIG. 5 is a perspective view of an embodiment of the fence structure cover assembly illustrating the existing fence pole orientation subsequent to the mating of the first and second panels and further illustrating the incorporation of the right angle end post.

The upper raised thickness portion 17 is positioned so that it is above upper edge 12A1 as illustrated in FIG. 2 and FIG. 5. Second panels 20 can be of any design and are flat on both sides. The second panels serve as a mating panel to sandwich fence 12 between first panel 15 and second panel 20. Attachment holes 15A1 suitable for a thru hole fastener (not shown) are present in first panel 15 and second panel 20. The holes are located through the upper raised thickness portion 17 and a lower raised thickness portion 18 of first panel 15 and are aligned with the holes 15A1 of second panel 20. As illustrated in FIGS. 1, 2 and 5, the upper raised thickness portion 17 allows for upper edge 12A1 to be encapsulated between first panel 15 and second panel 20. The thru hole fastener engages the first panel 15 and second panel 20 thus sandwiching the fence 12 therebetween.

Figure 2A:
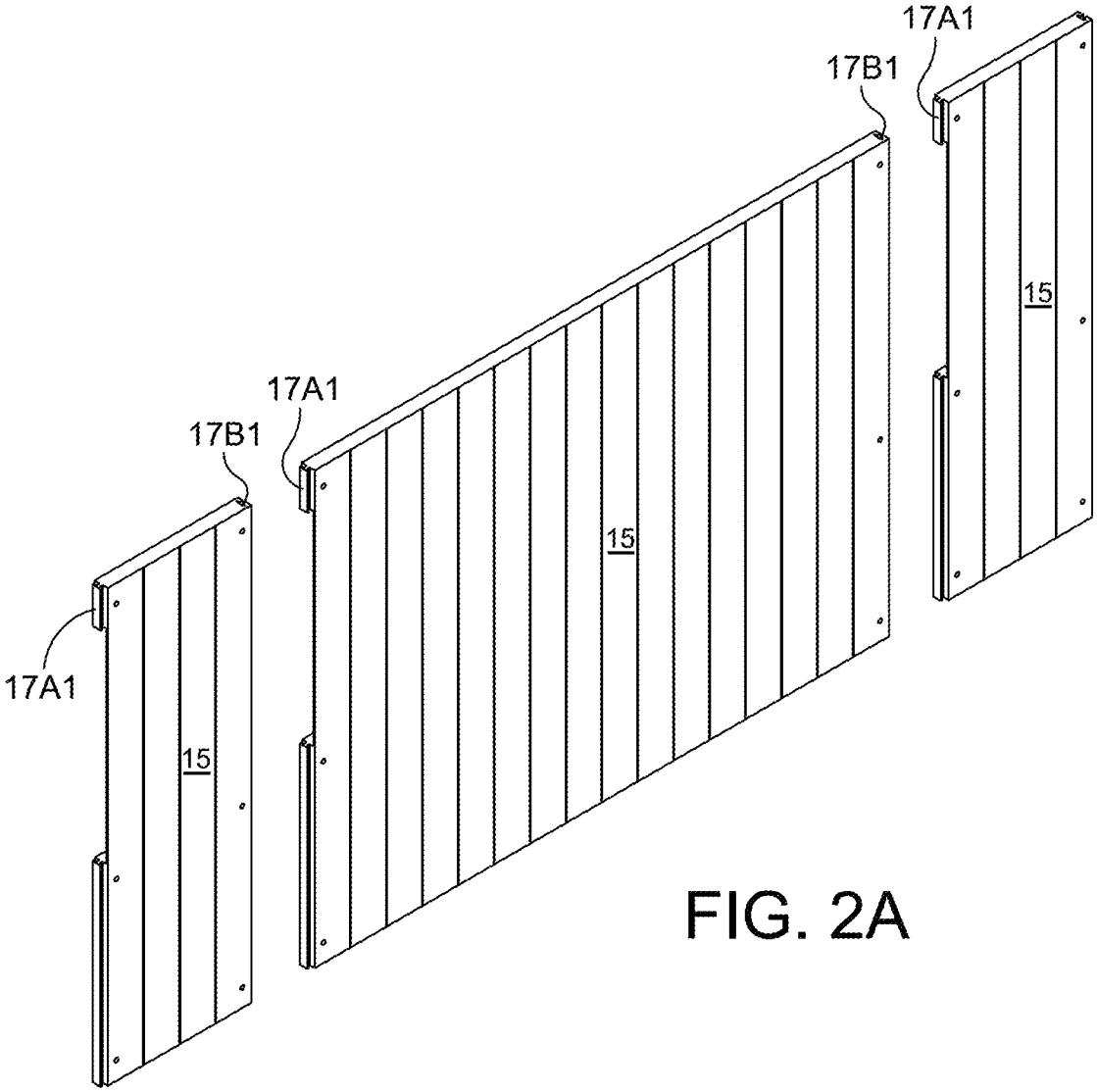
FIG. 2A illustrates a fence cover assembly first panel having an alternate dimension.
Figure 4A:
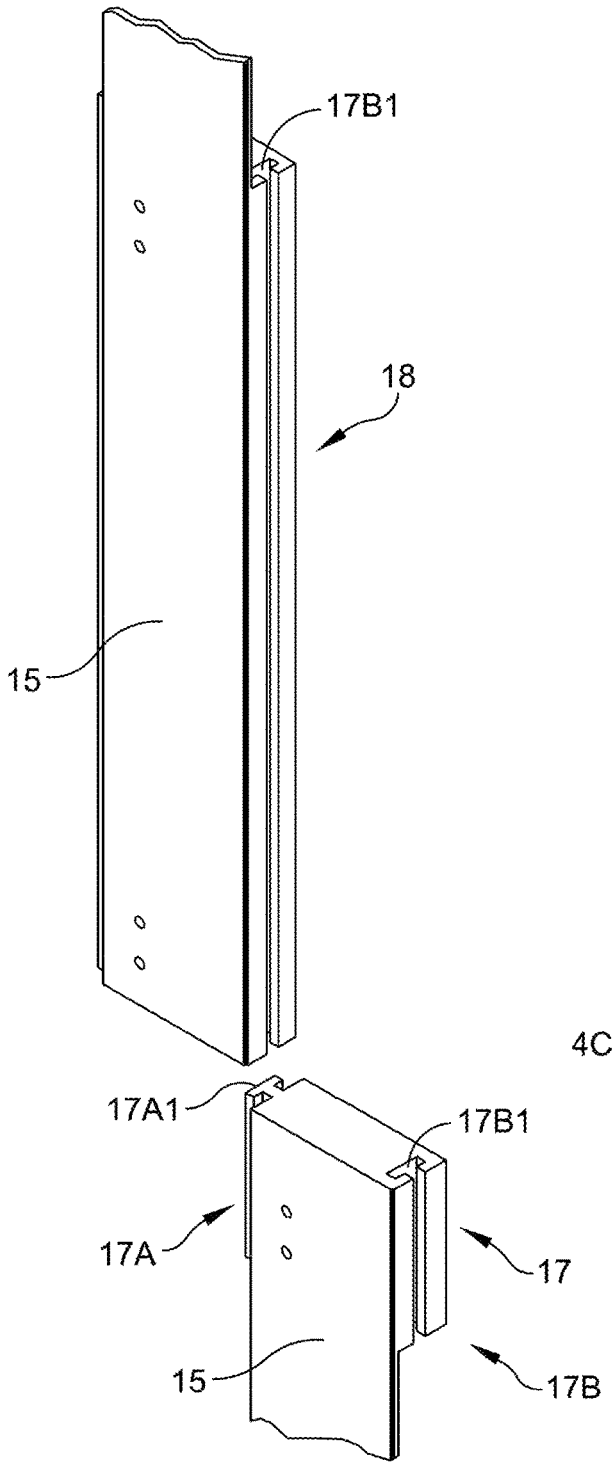
FIG. 4A is a perspective view of an embodiment of a first panel assembly illustrating the tongue and groove connection ends prior to joining adjacent panels.
Figure 4B:
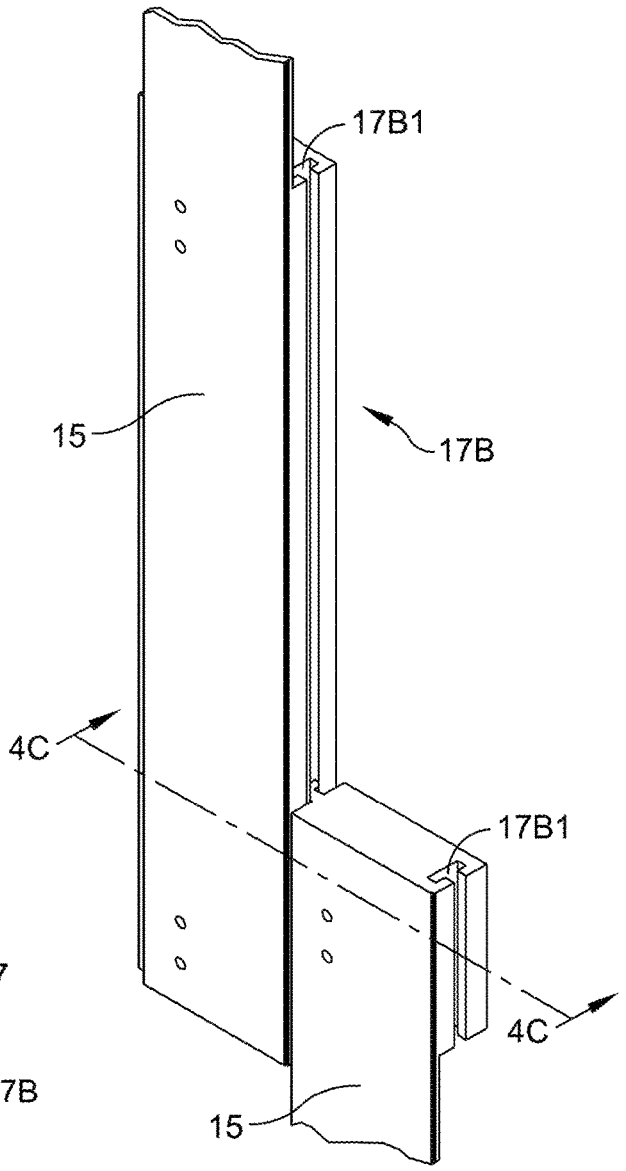
FIG. 4B is a perspective view of an embodiment of a first panel assembly illustrating the tongue and groove connection ends subsequent to joining adjacent panels.
Figure 4C:
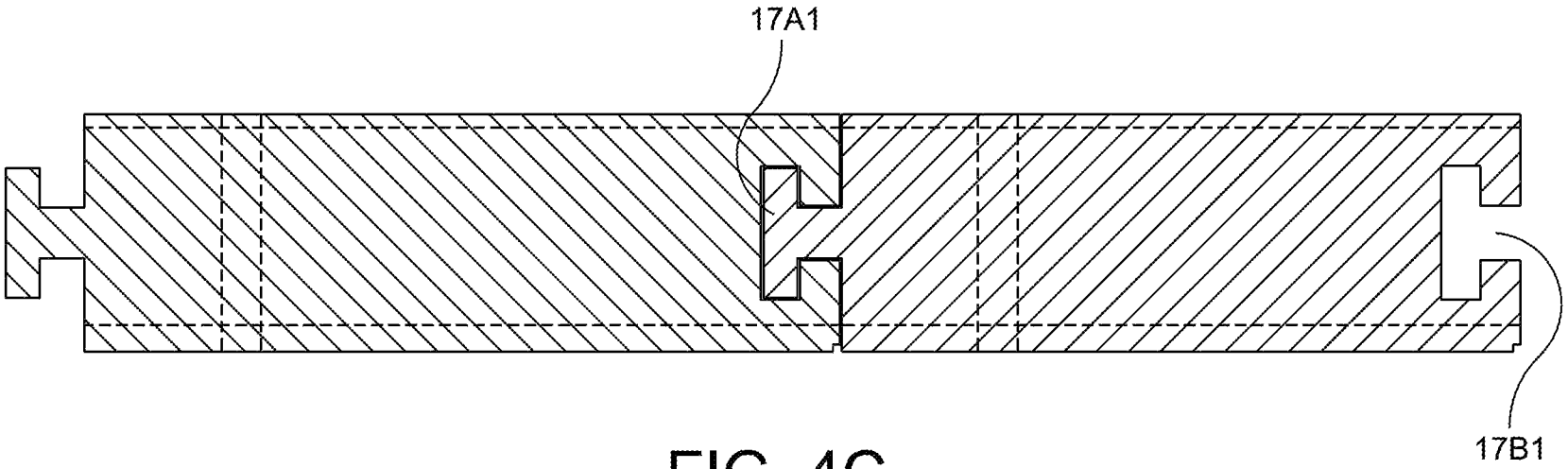
FIG. 4C is a cross-sectional view of the tongue and groove connection ends subsequent to joining adjacent panels.

Furthermore, existing fence 12 may include an upper fence horizontal post 12A2 that can be encapsulated between first panel 15 and second panel 20 (FIG. 2). Depending on the thickness of horizontal post 12A2 upper raised thickness portion 17 and lower raised thickness portion 18 can made thicker to accommodate the fitment of existing fence therein. Upper raised thickness portion 17 and lower raised thickness portion 18 also serve to provide the fence cover assembly rigidity. As illustrated in FIG. 2A, multiple first and second panels, of varying sizes, can be combined to accommodate varying distances between fence posts. As illustrated in FIG. 4A through 4C the panels may be of a narrow width.

Illustrative first panel portions 15 are mated together via a locking tongue and groove system. As illustrated in FIG. 4A, to mate the panels together would require one panel being lifted above an adjacent panel and the two panels being engaged. First edge 17A of first panel 15 includes extension tab 17A1 and on the opposite side of panel 15 a second edge 17B including a locking slot 17B1. Successive panels 15 may be joined by engaging extension tab 17A1 into locking slot 17B1 as illustrated in FIG. 4B and FIG. 4C.

Figure 6C:
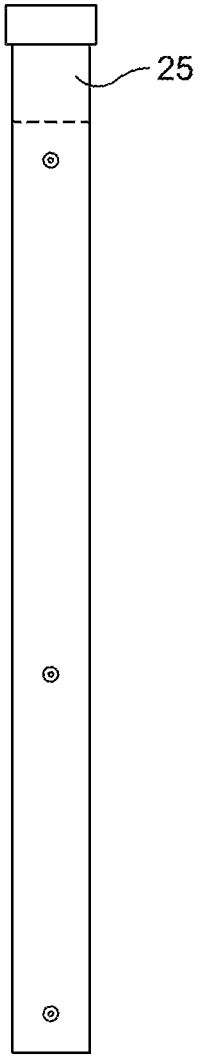
FIG. 6C is an side view of an end post of the present invention.
Figure 6B:
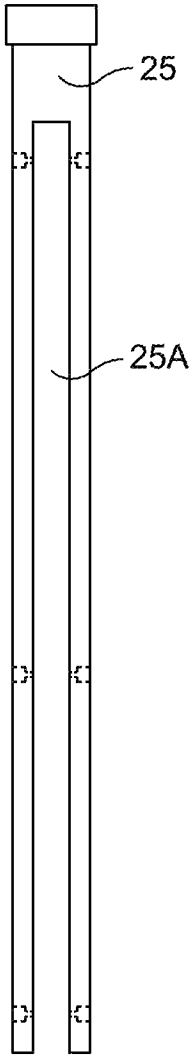
FIG. 6B is a front view of an end post of the present invention.
Figure 6A:
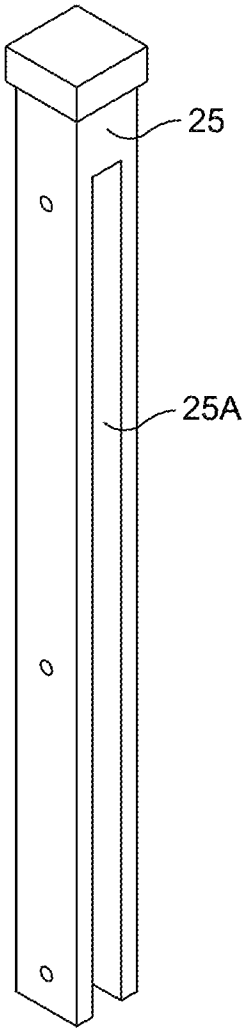
FIG. 6A is a perspective view of an end post of the present invention.
Figure 9C:
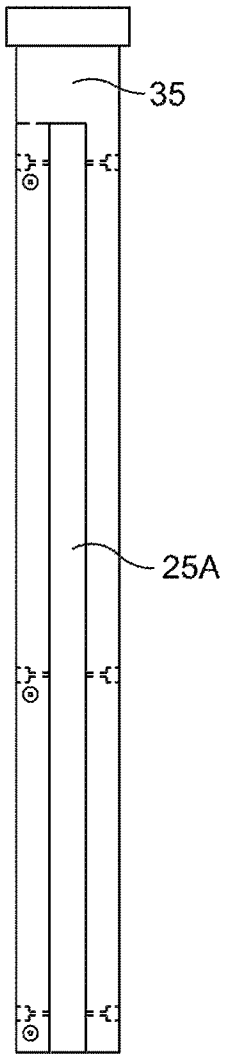
FIG. 9C is right side view of FIG. 9A.
Figure 9B:
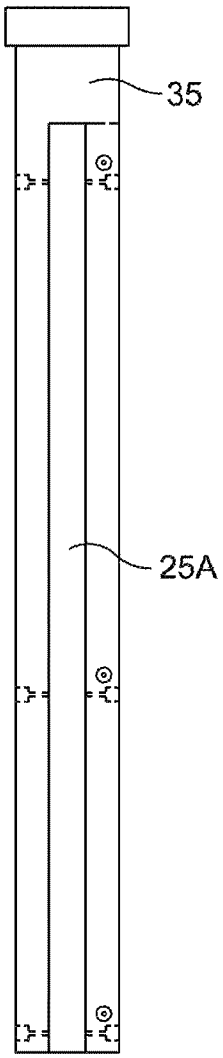
FIG. 9B is a front view of FIG. 9A.
Figure 9A:
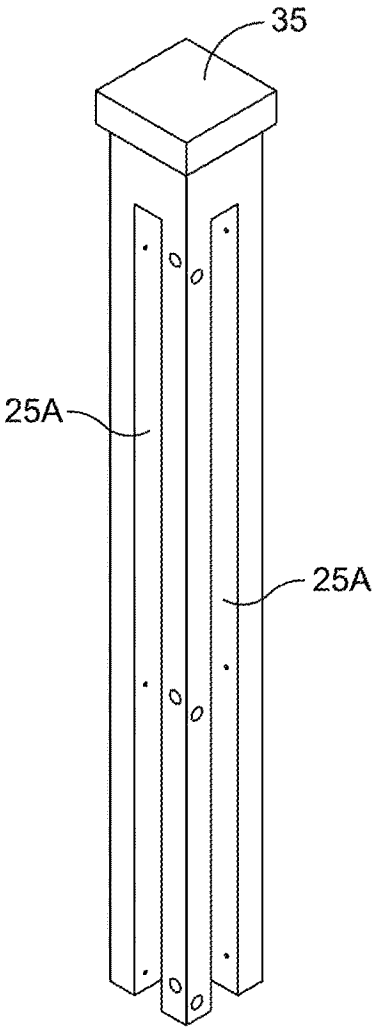
FIG. 9A is a perspective view of an embodiment of a right angle end post of the present invention.
Figure 10D:
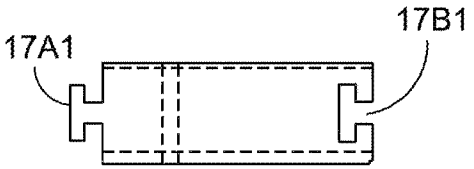
FIG. 10D is a top view of FIG. 10A.
Figure 10C:
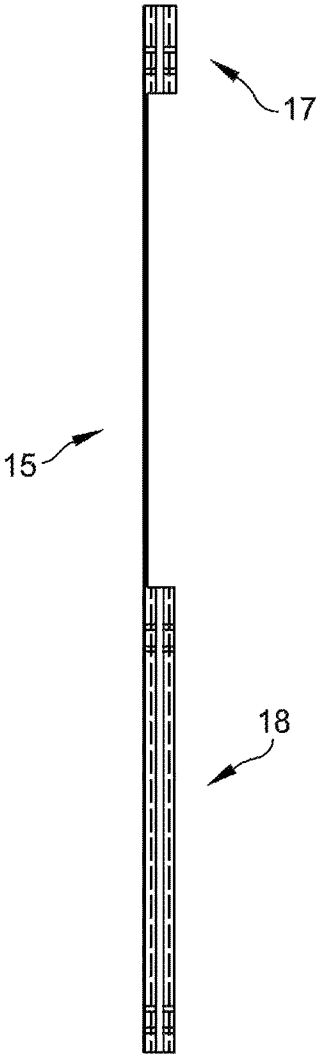
FIG. 10C is a side view of FIG. 10A.
Figure 10B:
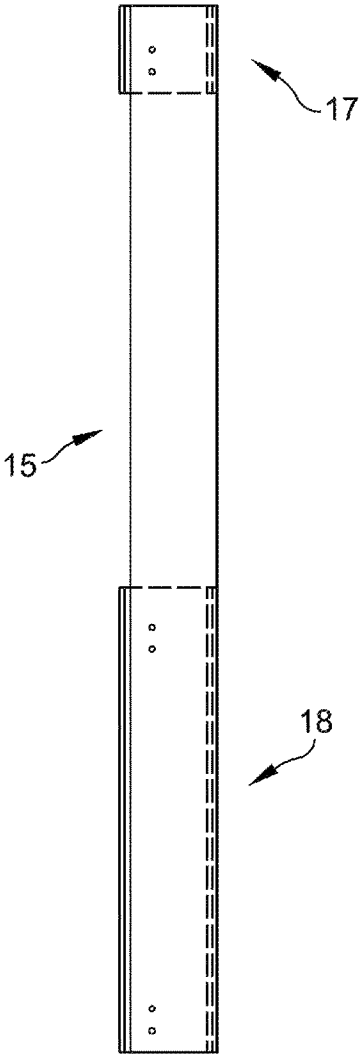
FIG. 10B is a front view of FIG. 10A.
Figure 10A:
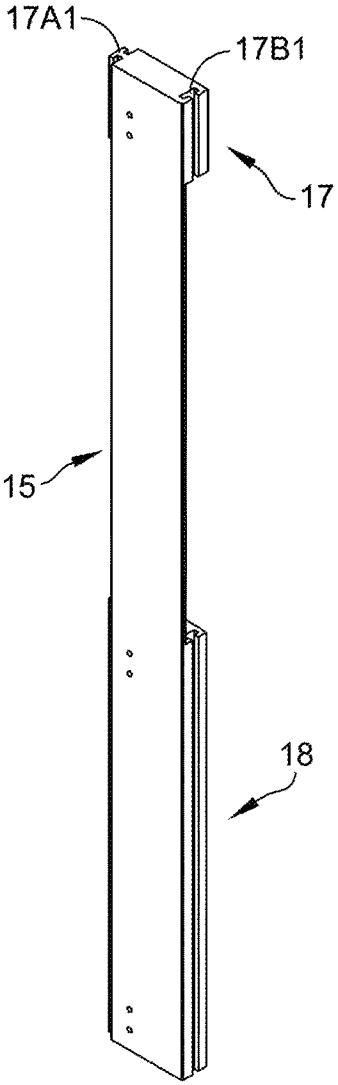
FIG. 10A is a perspective view of an embodiment of a first panel assembly of FIG. 4A illustrating the relative dimensions of the upper and lower backing panels.
Figure 11:
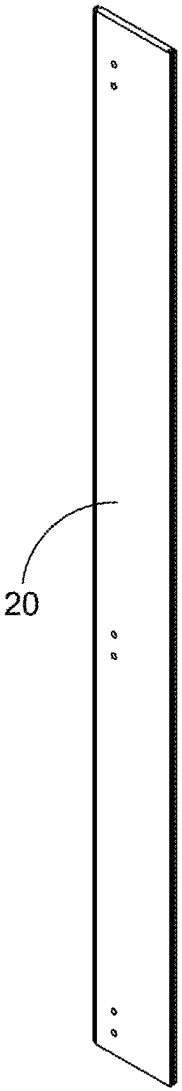
FIG. 11 is a perspective view of the back panel mateable to FIG. 10A.

As illustrated in FIG. 1 , various post structures including end posts 25, middle posts 30 and right angle posts 35 are utilized in the present invention. The posts include interior openings so the post can encapsulate an existing fence posts as illustrated in FIG. 1. FIG. 6A-FIG. 6C illustrate and end post 25 having an opening 25A and FIGS. 9A-9C illustrates a right angle post 35 having openings 25A.

It should be understood that the foregoing description is only illustrative of the invention. Thus, various alternatives and modifications can be devised by those skilled in the art without departing from the invention. Accordingly, the present invention is intended to embrace all such alternatives, modifications and variances that fall within the scope of the appended claims.

I claim:

1. A fence structure cover assembly for covering an existing fence, the existing fence including a linked mesh having a lower and upper edge extending between a plurality of vertical posts, comprising:

a plurality of first and second panels , the first panels having a front and a back, the back of said first panels comprising an upper and lower raised thickness portion;

said plurality of said first and said second panels mateable to secure the linked mesh therebetween.

2. A fence structure cover assembly as in claim 1 wherein said upper raised thickness portion extends above the upper edge of the linked mesh.

3. A fence structure cover assembly as in claim 1 wherein said lower raised thickness portion rests against the linked mesh.

4. A fence structure cover assembly as in claim 1 wherein said plurality of first panels include attachment holes in said upper and lower thickness extensions, said plurality of second panels further including corresponding aligned attachment holes, said aligned attachment holes further including fastener means therein for engaging said plurality of said first and second panels.

5. A fence structure cover assembly as in claim 1 wherein said upper raised thickness portion includes a first and second edge, and said lower raised thickness portion includes a first and second edge, said first edge of said upper and lower raised thickness portions including an extension tab, and said second edge of said upper and lower raised thickness portions including a locking slot, said plurality of said first panels secured together upon engagement of said extension tab in said locking slot.

6. A fence structure cover assembly as in claim 1, wherein said fence structure cover assembly further includes a plurality of post covers to secure over the vertical posts, the post covers further including openings for the securement of said first and second edges of said upper and lower raised thickness portions therein.

7. A fence structure cover assembly for covering an existing fence, the existing fence including a linked mesh having a lower and, upper edge extending between a plurality of vertical posts, and a plurality of horizontal posts positioned above the linked mesh upper edge and extending between the plurality of vertical posts, comprising:

a plurality of first and second panels , the first panels having a front and a back, the back of said first panels comprising an upper and lower raised thickness portion, wherein said upper raised thickness portion extends above the horizontal post;

said plurality of said first and said second panels mateable to secure the linked mesh therebetween.

8. A fence structure cover assembly as in claim 7 wherein said upper raised thickness portion includes a first and second edge, and said lower raised thickness portion includes a first and second edge, said first edge of said upper and lower raised thickness portions including an extension tab, and said second edge of said upper and lower raised thickness portions including a locking slot, said plurality of said first panels secured together upon engagement of said extension tab in said locking slot.

9. A fence structure cover assembly for covering an existing fence, the existing fence including a linked mesh having a lower and upper edge extending between a plurality of vertical posts, comprising:

a plurality of first and second panels , the first panels having a front and a back, the back of said first panels comprising an upper and lower raised thickness portion, wherein said upper raised thickness portion extends above the upper edge of the linked mesh, and wherein said upper raised thickness portion includes a first and second edge, and said lower raised thickness portion includes a first and second edge, said first edge of said upper and lower raised thickness portions including an extension tab, and said second edge of said upper and lower raised thickness portions including a locking slot, said plurality of said first panels secured together upon engagement of said extension tab in said locking slot;

said plurality of said first and said second panels mateable to secure the linked mesh therebetween.

* * * * *